United States Patent [19]

Suman

[11] Patent Number: 4,577,696

[45] Date of Patent: Mar. 25, 1986

[54] SEQUENTIAL INFLATABLE PACKER

[75] Inventor: George O. Suman, Houston, Tex.

[73] Assignee: Completion Tool Company, Houston, Tex.

[21] Appl. No.: 596,854

[22] Filed: Apr. 5, 1984

[51] Int. Cl.[4] ..... E21B 33/12

[52] U.S. Cl. ..... 166/387; 166/187

[58] Field of Search ..... 166/187, 387; 277/34.6

[56] References Cited

U.S. PATENT DOCUMENTS

| | | | |
|---|---|---|---|
| 2,831,541 | 4/1958 | Conover | 277/34.6 |
| 3,052,302 | 9/1962 | Lagucki | 277/34.6 |
| 3,525,393 | 8/1970 | Cobbs et al. | 166/187 |
| 4,372,562 | 2/1983 | Carter, Jr. | 166/187 |
| 4,420,159 | 12/1983 | Wood | 166/187 |
| 4,449,584 | 5/1984 | Christensen | 166/187 |
| 4,458,752 | 7/1984 | Brandell | 166/187 |

FOREIGN PATENT DOCUMENTS

| | | | |
|---|---|---|---|
| 718724 | 9/1965 | Canada | 166/187 |

*Primary Examiner*—Stephen J. Novosad
*Assistant Examiner*—William P. Neuder

[57] ABSTRACT

In a completion of an oil well where the well bore traverses the earth formations, a multiple series of inflatable packer elements are employed with each packer element having a defined sequential dependency of inflation to inflate the lowermost packe first then to inflate the packers in a sequence from the lowermost packer upwardly.

4 Claims, 5 Drawing Figures

SEQENTIAL INFLATABLE PACKER

BACKGROUND OF THE INVENTION

This invention relates to control of the inflation of tandem, inflatable formation packers disposed on a string of casing in a well bore which traverses earth formations, and more particularly, to a system for sequentially actuating tandem arranged inflatable formation packers so that the packers are inflated in a sequence from the bottom packer upwardly in a well bore.

In completion of oil wells, one completion system involves the use of a number of inflatable formation packers disposed lengthwise along a string of casing disposed in a well bore. In operation, the supporting casing is filled with fluid as is the annulus between the packers and casing and the well bore. When it is desired to inflate the formation packers, pressure is supplied through the fluid in a casing which acts upon an enclosed internal space of the formation packers and expands them radially outward into contact with the wall of the well bore. Obviously, when the inflatable packers expand, the fluid that originally occupies the annular volume between the packers and well bore is displaced. The displacement of the fluid in the annular volume may (1) move upwardly to displace fluid upwardly in the casing well bore annulus, (2) move downwardly and enter permeable intervals between the packers, (3) enter permeable intervals adjacent to or between the packers, (4) initiate and flow into fractures adjacent to, between or below the packers, and/or, (5) become trapped in borehole irregularities preventing complete inflation of the packers. Only movement of the fluid upwardly in the annulus is desirable as the interaction of trapped fluids with the borehole adversely affects the formations and operation of the packers.

Heretofore, there has been no effective control of the packer inflation where multiple packers are utilized. For example, inflation of the top packer first can form a flow restriction that completely prevents upward movement of the displaced fluid. Random inflation of the packers traps annular fluid along the packers if they inflate at different rates.

Thus, the purpose of the present invention is to inflate the packers in a predetermined manner so that upward movement of the fluid in the annulus between the borehole and the packer or casing occurs first at the lowermost inflatable packer and by sequentially inflating the packers in an upward direction thereby facilitating a complete unhampered inflation of the packers and upward flow of fluid and thereby minimizing the risk of well damage by virtue of trapped fluid.

Heretofore, it has been proposed to obtain sequential inflation of packers by sequential operation of pressure differentially actuated valves disposed in tandem packers where the pressure operated valves are set to open sequentially in response to pressure beginning with the lowermost packer first. This pressure responsive system has application under certain downhole conditions. In many instances, however, downhole pressure, under normal operating conditions, cannot be directly monitored at the surface and data from the surface pressure measuring devices must be combined with the expected hydrostatic pressures to estimate the pressure that is acting on a given valve at a given depth within the well bore. Thus, there is considerable room for inaccuracy in this system and errors resulting from inaccurate surface readings and/or unexpected hydrostatic forces often exceed the margin of error. That is, the error in the actual pressure exceeds the difference between the pressure settings of pressure operated valves in different packers resulting in the simultaneous opening of two or more pressure valves in two or more packers and the resulting failure of the packer system to sequentially operate. Also, in some cases the number of packers that may be run in tandem in a well bore is limited because the pressure differential required to open the valve in uppermost packer cannot be effectively attained in the casing.

THE PRESENT INVENTION

In the present invention, the fluid access valves in the packers which admit fluid to inflate the packers can be opened simultaneously. Sequential inflation of packers is attained by controlling the flow rate of inflation fluid to each packer so that the inflation flow rate to a lower packer is substantially greater than the flow rate to the next above packer so that the packers inflate sequentially from the bottom packer upwardly. Thus, by controlling the flow rate, the time of inflation of each packer is controlled so that the packers can be inflated sequentially.

The embodiment of the present invention involves a series of tandem connected inflatable packers up to 40 feet in length and coupled in a casing string. Each of the packers has a valving system to selectively control access of fluid within the casing to the interior of the inflatable packer element of a packer. The valving system may be of any conventional type in which a valve opens in response to pressure within the casing. The valves of the packers can be opened contemporaneously or with selectivity beginning with the bottommost packer.

The control of inflation is obtained by controlling the rate of inflation of each packer from the bottom up so that the lowermost packer element inflates first and the next above packer inflates next and so forth in an upward sequence of inflation. The rate of inflation is controlled by controlling the flow of fluid to each packer. This may be accomplished by any flow rate device such as flow orifices or flow rate valve.

A flow rate valve embodiment illustrates a pressure operated adjustable valve where the flow rate is controlled as a function of pressure.

DESCRIPTION OF THE INVENTION

Figure 1:
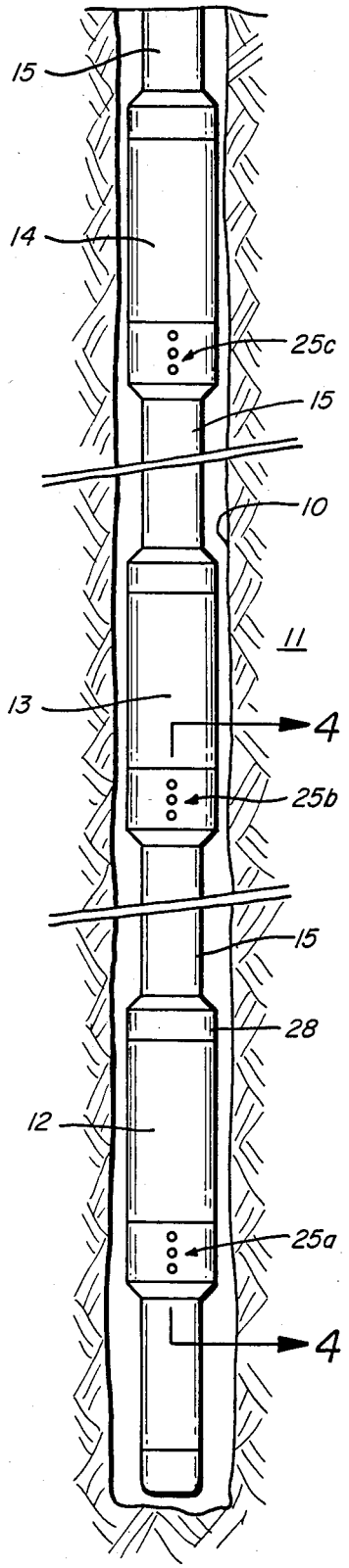
FIG. 1 illustrates a series of tandem inflatable packers in a well bore.

Referring now to FIG. 1, a borehole 10 traversing earth formations 11 is illustrated. The borehole 10 is initially filled with drilling mud and in a completion operation, a number of inflatable packers 12, 13 and 14 are coupled in a drill string or casing or pipe 15 so that the packers can be located adjacent to formations which are to be completed when disposed in the borehole 10. The inflatable packers 12, 13 and 14 are made in appropriate lengths which can range up to forty feet in length.

Figure 2:
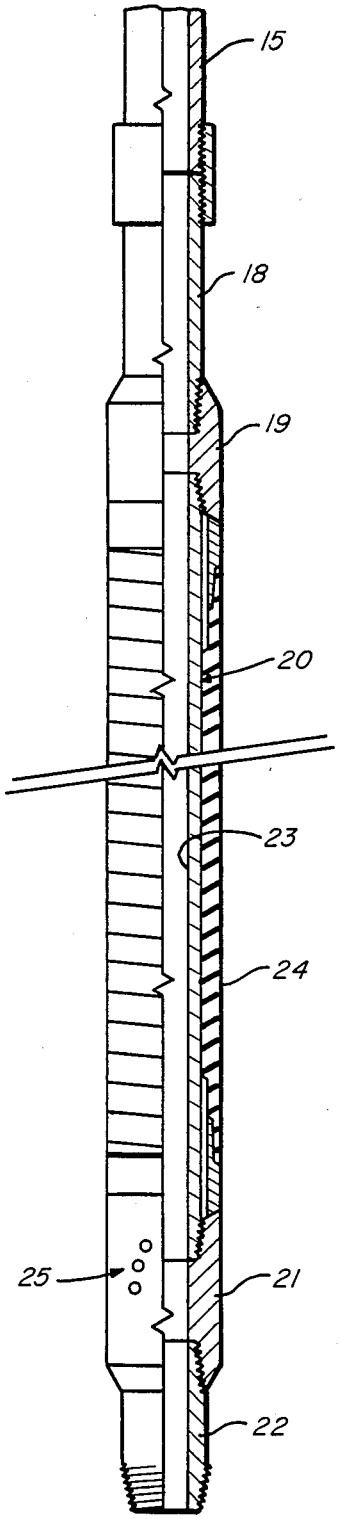
FIG. 2 illustrates a typical inflatable packer construction.

Each of the inflatable packers typically includes from top to bottom (See FIG. 2) an upper connecting sub 18, an upper collar 19, a central tubular mandrel 20, a lower valve collar 21 and a lower connecting sub 22. The subs 18 and 22 are connectable by collars to a section of casing pipe. The bore 23 through a packer is uniform and matches the bore of a casing or pipe 15. A tubular, elastomer constructed, inflatable packer element 24 surrounds the mandrel 20 and is sealingly connected to the upper collar 19 and lower valve collar 21. The valve collar 21, as will be explained later, contains valve members 25 which selectively admit fluid from the bore 23 to the interior of the inflatable element 24 for inflation of the element 24 into contact with the wall of a well bore and to limit and contain fluid admitted to the interior of the inflatable element 24.

Referring again to FIG. 1, the assembly of casing pipe 15 and inflatable packers 12, 13, 14 are positioned in a borehole 10 and cement in fluid form is displaced through the casing or pipe 15 and into the annulus 28 between the borehole 10 and the entire assembly on the casing 15. After the cement is displaced in the annulus to a point above the uppermost packer 14, the valves 25*a*–25*c* in the respective valve collars of the packers 12, 13 and 14 are actuated and the packers 12, 13 and 14 are inflated in sequence beginning with the lowermost packer 12. As the packer 12 is inflated the fluid in the annulus 28 is moved upwardly as packers 13 and 14 are not yet inflated. After packer 12 is inflated, the packer 13 is fully inflated moving the fluid in the annulus upwardly. After fully inflating packer 13, the packer 14 is fully inflated and moves the fluid in the annulus upwardly. As can be appreciated, the flow of fluid in the annulus 28 is always in an upward direction and is not adversly applied to the formations adjacent to or below a packer. After the packers are fully inflated and the cement set up, a perforating gun (not shown) can be lowered through the casing to complete the earth formations by placing them in fluid communication with the casing.

Figure 3:
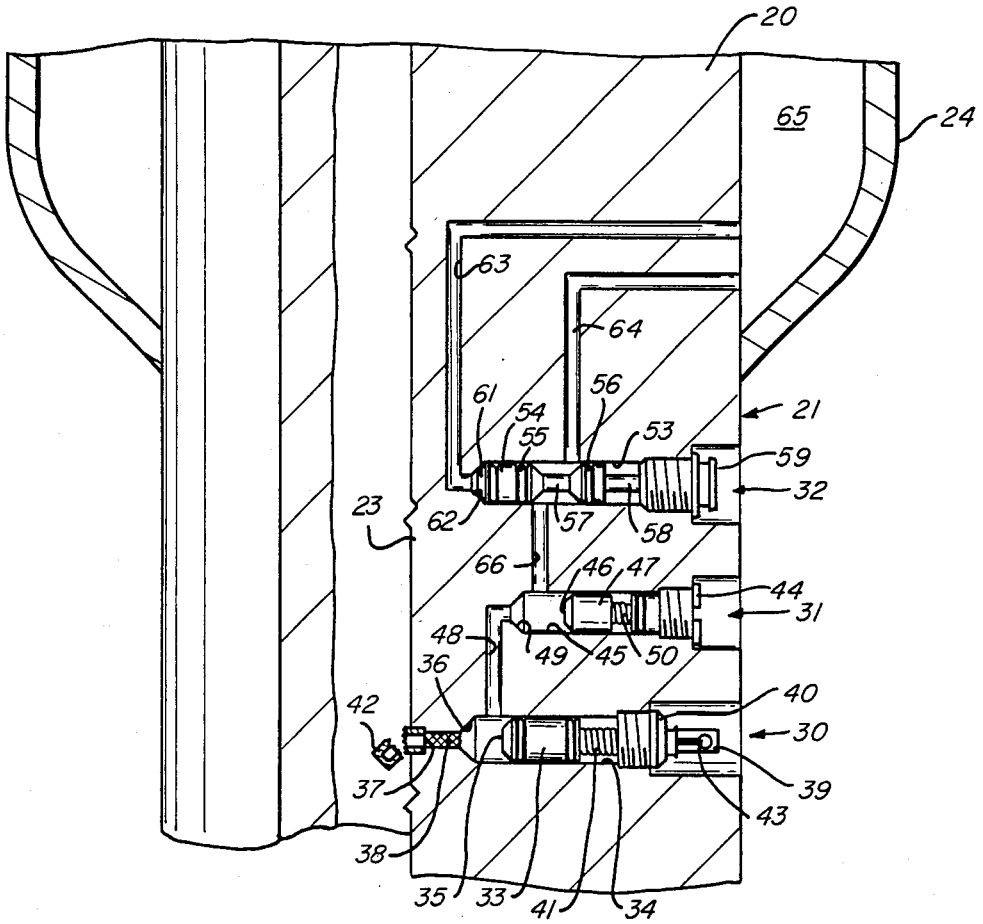
FIG. 3 illustrates a typical valve inflation system for an inflatable packer.

The valve collar 21 and packer element 24 are illustrated schematically and disproportionally in FIG. 3 where in the wall of the collar 21 contains a shear valve 30, a check valve 31 and a limit valve 32.

The shear valve 30 is comprised of a cylindrically shaped valve element 33 which is slidably disposed in a bore 34. The valve element 33 has a sealing element 35 at one end which is adapted in a closed position of the valve to sealingly engage a valve seat 36 and close off an access bore 37. The access bore 37 extends between the mandrel bore 23 and the valve bore 34. In the access bore 37 is a filter 38. The access bore 37 is initially closed by a hollow, knock-off plug 42 which projects into the mandrel bore 23. The valve element 33 has a smaller diameter pin element 39 at one end which extends through an opening in a closure cap 40. A spring member 41 is mounted on the pin element 39 and is disposed in the bore 34 between the cap 40 and the valve element 33 to normally bias the valve element 33 to a closed position with the sealing element 35 engaging the valve seat 36. The valve element 34 may also carry O-ring seals for straddling a fluid communication passage 48 in a closed position of the valve 30. Initially, the shear valve 30 is in a closed condition and a shear pin 43 with a predetermined shear value cooperates with the cap 40 to releasably lock the valve element 33 in a closed position. The spring member 41 is thus initially in an extended position.

When the knock-off plug 42 is broken (by dropping a member through the mandrel bore 23) fluid under pressure in the mandrel bore 23 is increased to a point where the shear pin 43 shears and the valve element 33 is moved to an open position and the spring member 41 is compressed. This is the position shown in FIG. 3. When the pressure in the mandrel bore 23 is less than the spring force, the valve 30 will close.

The check valve 31 is comprised of a valve bore 45 which receives a slidable valve element 47 having a sealing element 46 on one end which is adapted in a closed position of the valve to sealingly engage a valve seat 49 and close off the fluid communication passageway 48. The passageway 48 extends between the valve bore 45 and the valve bore 34 so that when the shear valve 30 is open, fluid is applied to the end of the valve element 47. The valve element 47 has a smaller diameter pin element within the valve bore which is slidably received in a hollow bore of a cap member 44 and a spring element 50 is disposed between the valve element 47 and cap member 44 to normally bias the valve element 47 to a closed position on the valve seat 49. The check valve 31 is shown in an open position where the pressure in the passageway 48 exceeds the spring force of the spring element 50.

The limit valve 32 is comprised of a valve bore 53 which receives a slidable valve element 54 which has spaced apart sealing members 55, 56. The sealing members 55, 56 are interconnected by a cylindrical pin 57 so that an annular flow passage is formed between the sealing members 55, 56. A pin member 58 extends rearwardly of the sealing member into a bore in a closure cap member 59. A sealing element 61 on the end of the sealing member 55 is adapted to engage a valve seat 62 and close a first bore or passageway 63 which extends through the collar body to the interior space 65 between the mandrel 20 and packer element 24. A second bore or passageway 64 extends through the collar body to the interior space between the mandrel 20 and packer element 24 and to the annular flow passage between sealing members 55, 56 on the valve element. In the position shown, fluid can pass via the passageways 48, 66 and 64 to inflate the packer element 24 and when the pressure in the packer element reaches a predetermined value, the valve element 54 is shifted to the right so that O-rings on the valve element 54 straddle the passageway 66 and entrap the pressure in the packer element.

Figure 4:
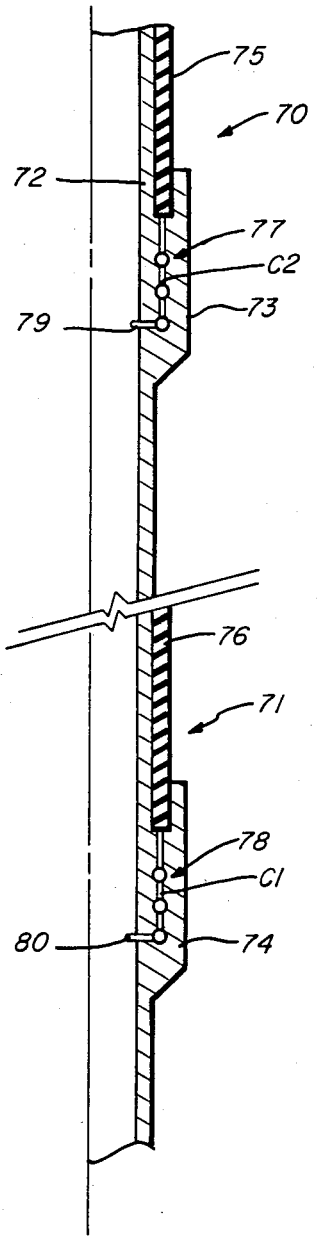
FIG. 4 illustrates schematically tandem packers with flow rate controllers.

With the foregoing description in mind, one structural embodiment for a controlling flow rates is schematically illustrated in FIG. 4 wherein a lower section of two inflatable packer means 70, 71 are supported by a tubular casing 72 and valve collars 73, 74. The valve collars 73, 74 respectively attached to inflatable elements 75, 76. The inflation spaces between the respective inflatable elements 75, 76 and the casing 72 are connected by valve and passageway systems 77, 78 to the access plugs 79, 80 disposed in the inner bore of the casing 72. The valve and passageway systems 77, 78 may be as illustrated herein or may be combination of valves or other types of inflation control means as is well known in the art so long as there is a pressure valve responsive in each of the valve and passageway systems with appropriate predetermined pressure operational valves for release so that each of the valve systems is timed to open at nearly the same time or from the bottom packer upwardly. It is contemplated that the valves in the upper packer means can have different values of pressure operation but the operation of the valves are not a critical factor as the flow rate of inflation is the material factor.

The flow rate of inflation in the packer 71 is controlled by a flow choke C1 in the passageway system 78 and the flow rate of inflation in the packer 70 is controlled by a flow choke C2 in the passageway system 77 so that the flow rate of the fluid to inflate the lowermost packer element 76 is greater than the flow rate of the fluid to inflate the next above packer element 75.

The choke C1 and C2 may be simple orifices for sizing the diameter of flow passages in the passageway system. Alternatively, the travel of a valve, such as valve 33, can be limited so that the end of a valve cooperates with a passageway opening to limit or control the flow rate. Still other ways of controlling flow rate can be used such as using different diameters for the openings at the knock-off plugs 79, 80.

Figure 5:
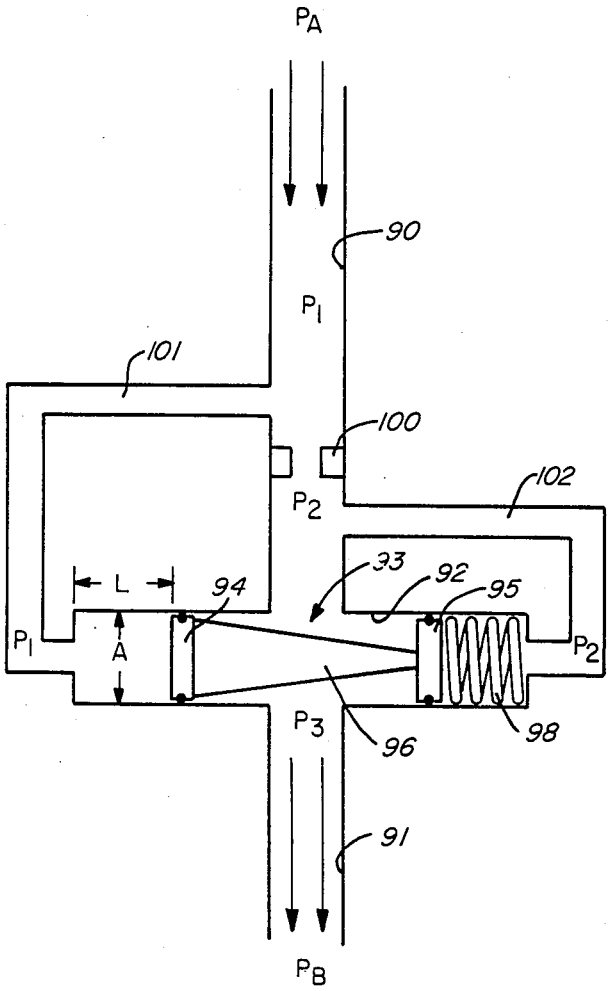
FIG. 5 illustrates a valve construction which is pressure operated.

Referring to FIG. 5, a variable choke system is schematically illustrated. In this system an inlet flow passage 90 in a valve collar extends from the interior of the casing to the variable choke system and an outlet flow passage 91 extends from the variable choke system to the interior space of the inflatable packer element. Between the inlet flow passage 90 and outlet flow passage 91 is a transverse cylindrical bore 92 which carries a spool type piston 93 with end piston members 94, 95 which connect to a conically shaped valve element 96.

The effective pressure areas of the pistons 94 and 95 are equal and a spring 98 is employed to urge the spool piston 93 towards one end of the passage 92 and fully open the communication of the inlet passage 90 to the outlet passage 91. In the inlet passage 91 is a flow orifice 100 which provides a constant pressure loss for fluid flow so that the pressure P1 above the orifice 100 is greater than the pressure P2 below the orifice 100. A first flow passage 101 connects the inlet passage 90 at a location above the orifice 100 to supply the pressure P1 to the effective seal area of piston 94. A second flow passage 102 connects the inlet passage 90 at a location below the orifice 100 to supply the pressure P2 to the effective seal area of piston 95.

The characteristics of the valve are:

$$P_2 = P_1 - V^n(PL) \quad (1)$$

Where $P_1$ is the inlet pressure above the orifice $P_2$ is the inlet pressure below the orifice n is usually a value of two (2)

V is the inlet fluid velocity and (PL) is the pressure loss constant of the orifice.

The position of the flow rate valve is determined by the relationship $$(P_1 - P_2)A = (SK)L \quad (2)$$

Where

A = is the piston cross section (SK) is the spring constant and L is the travel length of the piston.

With the foregoing values, the orifice 100 can be different in each packer and the inflation rate is automatically controlled in each packer means. Likewise, the shape of spool piston 93 can be different in each packer and the inflation rate differently controlled. Also, the spring constant can be different in each packer and the inflation rate differently controlled.

It will be apparent to those skilled in the art that various changes may be made in the invention without departing from the spirit and scope thereof and therefore the invention is not limited by that which is enclosed in the drawings and specifications, but only as indicated in the appended claims.

I claim:

1. A method of setting more than one inflatable packer means in sequence while disposed in a casing string in a well bore traversing earth formations including the steps of:

disposing at least two inflatable packer means in a longitudinally spaced apart relationship in a tubular casing string in a well bore traversing earth formations where said well bore contains fluid, and said packer means each have inflatable packer elements which are responsive to fluid under pressure in the casing string to inflate into a sealing relationship with a wellbore;

applying pressure to the fluid in the interior of the casing string sufficient to cause fluid to flow through a passage from the interior of the casing string to the interior space behind each of said inflatable packer elements;

controlling the flow rate of fluid in the passage to the interior space behind each of said inflatable packer elements at different flow rates so that the inflation of the packer elements occurs simultaneously but progressively in a upward direction with the lowermost packer means inflating faster than the next above packer means.

2. The method as set forth in claim 1 wherein the fluid in the well bore is a cement slurry.

3. The method as set forth in claim 2 wherein the inflatable packers are up to forty feet or more in length.

4. Apparatus for use in a well bore traversing earth formations comprising:

first and second inflatable packer means coupled in a string of tubular casing traversing earth formations where the well bore contains fluid and each of said packer means has inflatable packer elements which are inflatable into sealing engagement with a well bore, first means including a first passageway for transmitting fluid under pressure from the interior of the string of casing to an interior space behind said inflatable packer element in said first packer means for inflating such packer element, first flow rate control means in said first passageway for controlling the flow rate of fluid to the interior space behind said inflatable packer element to provide a first flow rate of inflation, second means including a second passageway for transmitting fluid under pressure from the interior of the string of casing to an interior space behind said inflatable packer element in said second packer means for inflating such packer element, second flow rate control means in said second passageway for controlling the flow rate to the interior space behind said inflatable packer element to provide a second flow rate of inflation, said first and second flow rate control means being functionally related to one another to provide a higher flow rate of fluid in a lowermost packer means than in the next above packer means for inflating a packer element on the lowermost packer means into sealing engagement with a wellbore prior to inflating a packer element on a packer means into sealing engagement with a well bore.

* * * * *